US011024494B2

(12) United States Patent
Le Blanc

(10) Patent No.: US 11,024,494 B2
(45) Date of Patent: Jun. 1, 2021

(54) ASSESSING MRM PEAK PURITY WITH ISOTOPE SELECTIVE MSMS

(71) Applicant: DH TECHNOLOGIES DEVELOPMENT PTE. LTD., Singapore (SG)

(72) Inventor: Yves Le Blanc, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/646,674

(22) PCT Filed: Sep. 25, 2018

(86) PCT No.: PCT/IB2018/057395
§ 371 (c)(1),
(2) Date: Mar. 12, 2020

(87) PCT Pub. No.: WO2019/064173
PCT Pub. Date: Apr. 4, 2019

(65) Prior Publication Data

US 2020/0279725 A1 Sep. 3, 2020

Related U.S. Application Data

(60) Provisional application No. 62/565,140, filed on Sep. 29, 2017.

(51) Int. Cl.
*H01J 49/00* (2006.01)
*H01J 49/42* (2006.01)

(52) U.S. Cl.
CPC ..... *H01J 49/004* (2013.01); *H01J 49/0027* (2013.01); *H01J 49/4215* (2013.01)

(58) Field of Classification Search
CPC ... H01J 49/004; H01J 49/0027; H01J 49/4215
See application file for complete search history.

(56) References Cited

U.S. PATENT DOCUMENTS

2013/0206979 A1 8/2013 Bonner et al.
2014/0095084 A1 4/2014 Tate et al.

FOREIGN PATENT DOCUMENTS

WO 2015189605 A1 12/2015
WO 2016125059 A1 8/2016

OTHER PUBLICATIONS

International Search Report and Written Opinion for PCT/IB2018/057395, dated Jan. 16, 2019.

(Continued)

*Primary Examiner* — Nicole M Ippolito
*Assistant Examiner* — Hanway Chang
(74) *Attorney, Agent, or Firm* — John R. Kasha; Kelly L. Kasha; Kasha Law LLC

(57) ABSTRACT

An interference in a first MRM transition measurement for a compound of interest is determined by using a second MRM transition that includes an isotope of the precursor ion in the first MRM transition. Both transitions include the same product ion. A first intensity is measured for the first MRM transition and a second intensity is measured for the second MRM transition. A ratio of the first intensity to the second intensity is calculated. A theoretical ratio of the quantity of first precursor ion to the second precursor ion is calculated according to their isotopic relationship. A difference between the ratio and the theoretical ratio is calculated and compared to a threshold value. If the difference is less than the threshold value, the first intensity of the first MRM transition is identified as including an interference for the compound of interest.

15 Claims, 10 Drawing Sheets

(56) References Cited

OTHER PUBLICATIONS

Bao et al. Detection and Correction of Interference in SRM Analysis Method, Jun. 15, 2016.

100

500

900

ASSESSING MRM PEAK PURITY WITH ISOTOPE SELECTIVE MSMS

RELATED APPLICATIONS

The present application claims the benefit of U.S. Patent Application No. 62/565,140, filed on Sep. 29, 2017, the entire contents of which are incorporated herein by reference.

INTRODUCTION

The teachings herein relate to systems and methods for determining if a multiple reaction monitoring (MRM) measurement made by a mass spectrometer includes an interference. More particularly, the teachings herein relate to systems and methods for obtaining a first MRM measurement for a first transition of a first precursor ion to a first product ion, obtaining a second MRM measurement for a second transition of a second precursor ion that is an isotope of the first precursor ion to the same first product ion, and comparing the ratio of the two measurements to a theoretical isotopic ratio of the first precursor ion and the second precursor ion to determine if the first MRM measurement includes an interference. The systems and methods herein can be performed in conjunction with a processor, controller, or computer system, such as the computer system of FIG. 1.

BACKGROUND

In many applications, an MRM ratio is the key parameter used to assess the purity of a liquid chromatography peak LC peak. This is typically performed by monitoring two or more MRM signals that each includes a different product ion for each analyte and comparing the MRM ratio to standards or a library of data acquired for the analyte. In this process, the same precursor ion is selected for each MRM at unit resolution (or at lower resolution) and multiple different product ions are used in each of the different MRMs. In this scenario, correlation of multiple MRM measurements is key in determining if the analyte signal is pure. This approach is widely used for small molecules and in recent years has also been used for peptides.

One drawback of this scenario is that it also requires a set of standards to be acquired for each analyte. The standards also have to be specific to each mass spectrometry system used to account for collision induced dissociation (CID) variability. In other words, this technique is dependent on the collection of a library of measurements for standard samples of each analyte for each mass spectrometry system.

As a result, there is a need for systems and methods for determining interferences in MRM measurements that are not dependent on comparisons with libraries built from standard samples.

SUMMARY

A system, method, and computer program product for determining if an MRM transition measurement for a compound of interest includes an interference are provided. An interference is determined by calculating the ratio of the intensity of an MRM transition for the compound of interest to an intensity of another MRM transition for the compound of interest. The two MRM transitions include different precursor ions. One precursor ion is an isotope of the other precursor ion. Both MRM transitions include the same product ion. A theoretical ratio of the quantity of the precursor ion to the quantity of its isotope is calculated according to their isotopic relationship. A difference between the ratio and the theoretical ratio is calculated. This difference is compared to a threshold value. If the difference is less than the threshold value, the MRM transition is identified as including an interference for the compound of interest.

The system includes a tandem mass spectrometer and a processor. The tandem mass spectrometer includes an ion source device, a mass filter, a fragmentation device, and a mass analyzer. The tandem mass spectrometer receives an ion beam from the ion source device that ionizes the compound of interest. The mass filter is adapted to produce a mass selection window capable of resolving isotopes of precursor ions from the ion beam. The tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
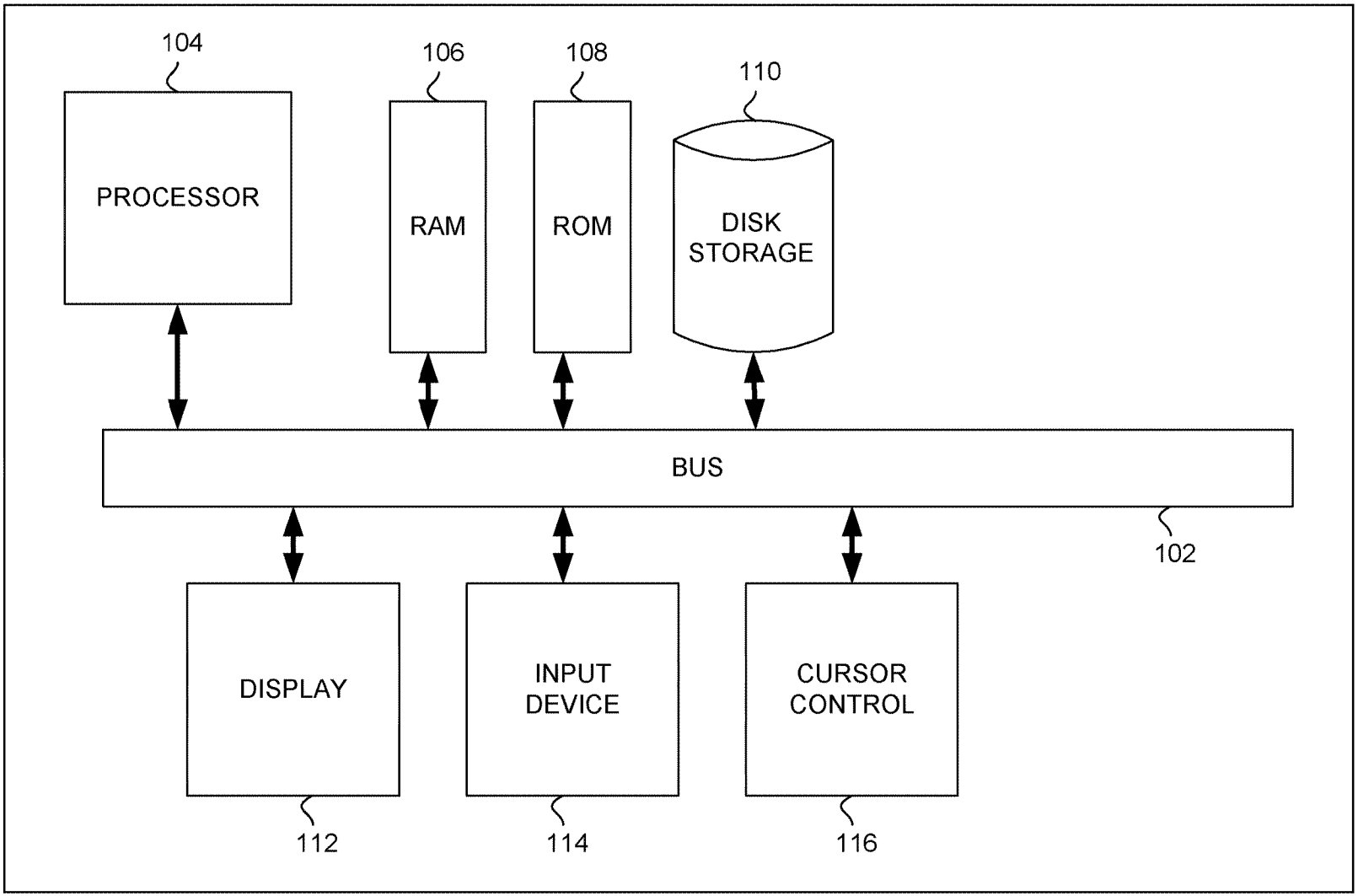
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Isotopic MRM Transitions

As described above, in many applications, a multiple reaction monitoring (MRM) ratio is the key parameter used to assess the purity of a liquid chromatography peak (LC) peak. This is typically performed by monitoring two or more MRM signals that each includes a different product ion for each analyte and comparing the MRM ratio of the signals to standards or library of data acquired for the analyte.

In general, tandem mass spectrometry, or mass spectrometry/mass spectrometry (MS/MS), is a well-known technique for analyzing compounds. Tandem mass spectrometry involves ionization of one or more compounds from a sample, selection of one or more precursor ions of the one or more compounds, fragmentation of the one or more precursor ions into fragment or product ions, and mass analysis of the product ions.

Tandem mass spectrometry can provide both qualitative and quantitative information. The product ions in the product ion spectrum can be used to identify a molecule of interest. The intensity of one or more product ions can be used to quantitate the amount of the compound present in a sample.

A large number of different types of experimental methods or workflows can be performed using a tandem mass spectrometer. One type of workflow is called targeted acquisition.

In a targeted acquisition method, one or more transitions of a precursor ion to a product ion are predefined for a compound of interest. As a sample is being introduced into the tandem mass spectrometer, the one or more transitions are interrogated during each time period or cycle of a plurality of time periods or cycles. In other words, the mass spectrometer selects and fragments the precursor ion of each transition and performs a targeted mass analysis for the product ion of the transition. As a result, an intensity (a product ion intensity) is produced for each transition. Targeted acquisition methods include, but are not limited to, multiple reaction monitoring (MRM) and selected reaction monitoring (SRM).

Figure 2:
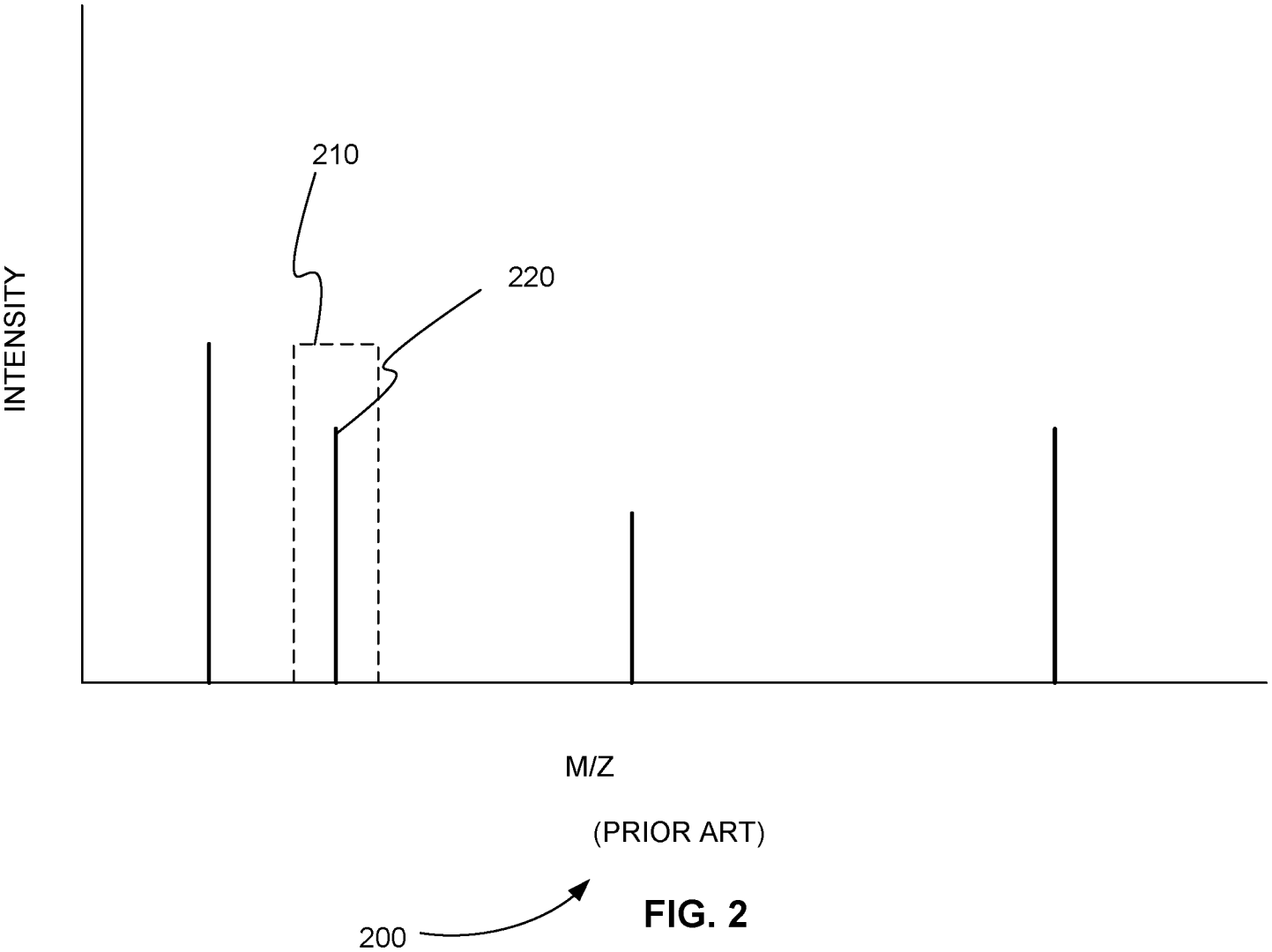
(PRIOR ART) FIG. 2
FIG. 2 is an exemplary plot of intensity versus mass-to-charge ratio (m/z) showing a mass selection window used in conventional multiple reaction monitoring (MRM) to select a precursor ion.

FIG. 2 is an exemplary plot 200 of intensity versus mass-to-charge ratio (m/z) showing a mass selection window used in conventional MRM to select a precursor ion. In FIG. 2, mass selection window 210 is used to select precursor ion 220. Mass selection window 210 selects precursor ion 220 typically at unit resolution or about 1 m/z. In other words, the width of mass selection window 210 is 1 m/z.

Plot 200 depicts a mass spectrum of precursor ions. However, it is not necessary to measure a precursor ion mass spectrum in MRM. In MRM, a precursor is simply selected and fragmented. It also is not necessary to measure a product ion mass spectrum in MRM. Instead, another mass window or resolution window is simply monitored for the expected product ion.

Figure 3:
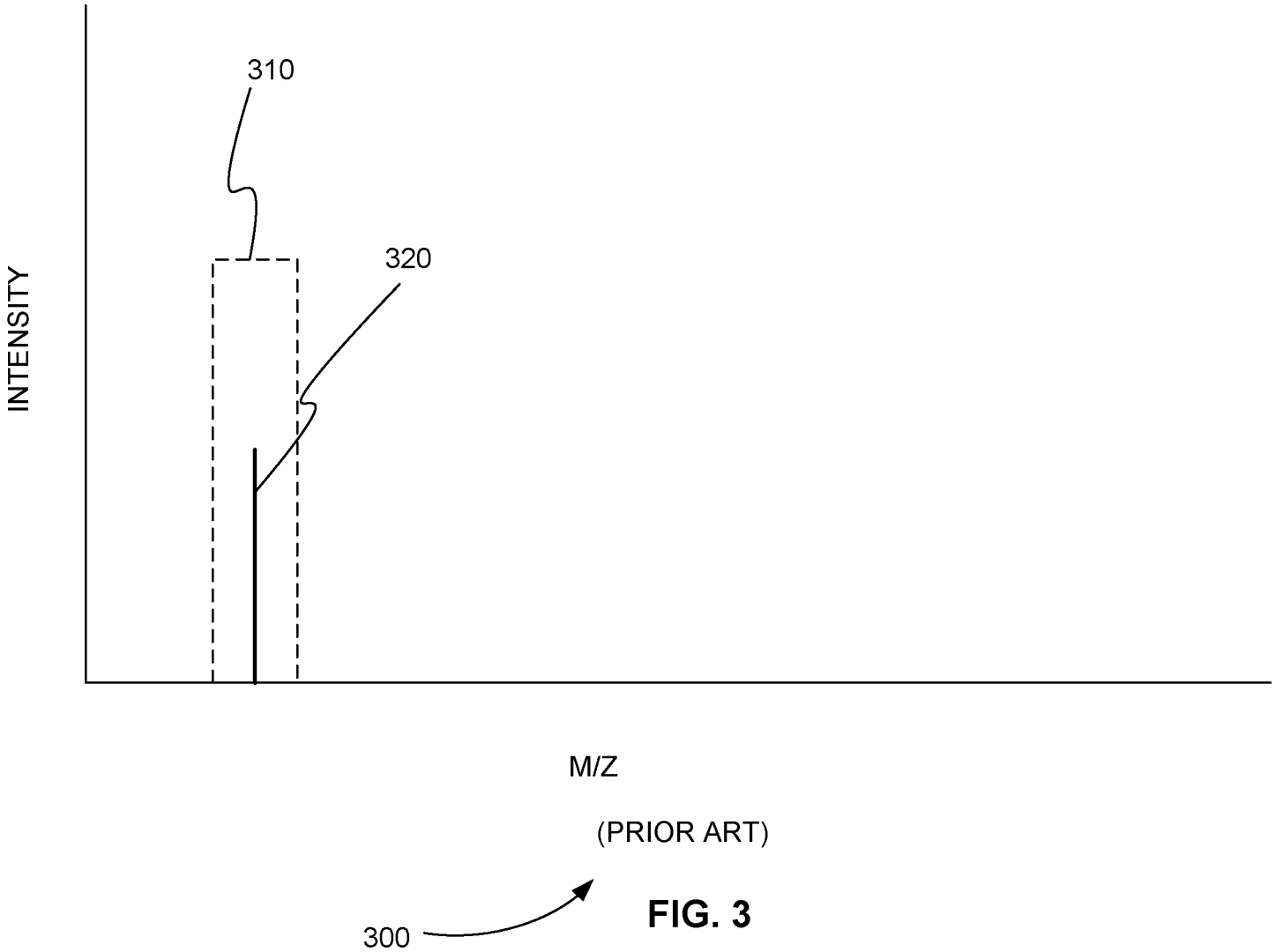
(PRIOR ART) FIG. 3
FIG. 3 is an exemplary plot of intensity versus m/z showing a mass window used in conventional MRM to monitor for a particular product ion of a selected precursor ion.

FIG. 3 is an exemplary plot 300 of intensity versus m/z showing a mass window used in conventional MRM to monitor for a particular product ion of a selected precursor ion. In FIG. 3, mass window 310 is used to monitor for product ion 320. Product ion 320 is a product ion of precursor ion 220 of FIG. 2, for example. The width of mass window 310 in FIG. 3 is typically wider than a precursor mass selection window and is on the order of 3 m/z.

The intensity of product ion 320 is the measurement that is made for the MRM transition from precursor ion 220 of FIG. 2 to product ion 320 of FIG. 3. MRM can also be performed in conjunction with a separation technique, such as LC. In this case, a particular MRM transition may be measured at a number of times during the separation, which are known as elution times or retention times, for example. From these multiple MRM measurements, an LC peak can be determined.

Figure 4:
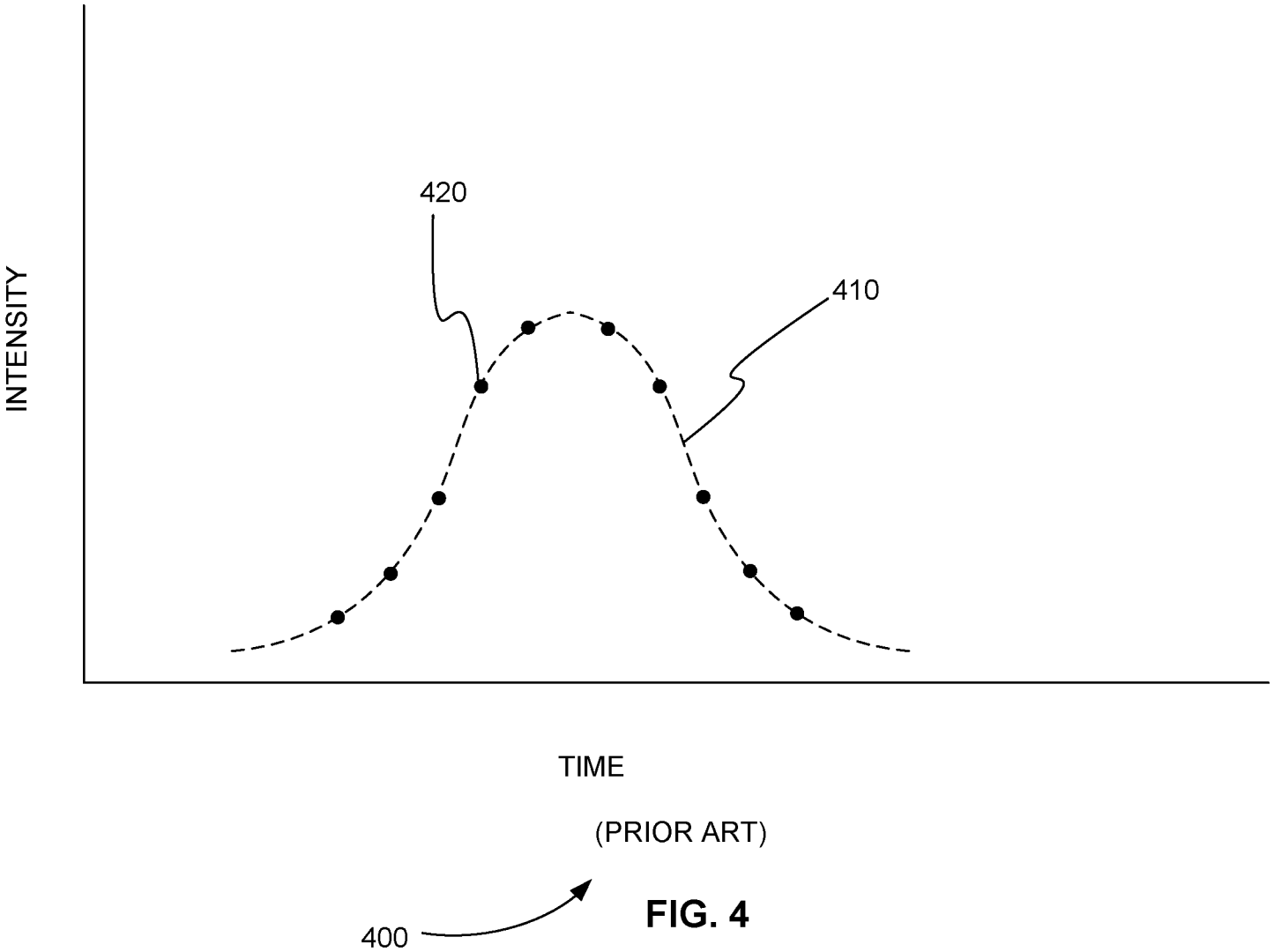
(PRIOR ART) FIG. 4
FIG. 4 is an exemplary plot of intensity versus time showing an LC peak formed from multiple MRM measurements made over a series of retention times.

FIG. 4 is an exemplary plot 400 of intensity versus time showing an LC peak formed from multiple MRM measurements made over a series of retention times. In FIG. 4, LC peak 410 is formed from MRM measurements at points 420. Each the MRM measurement at points 420 is made at different elution time. The shape of an LC peak, such as LC peak 420, can be used to identify or quantitate an analyte or compound of interest. Any interferences in the MRM measurements, however, can change or distort the shape of an LC peak confounding the identification or quantitation.

As a result, conventionally, one or more other MRM measurements for other MRM transitions are made at the same retention times. The other MRM transitions include the same precursor ion but a different product ion. The ratios of these MRM measurements from different transitions to each other are then compared to standard ratios collected in a library of measurements made by the same mass spectrometry system from standard samples of the compound of interest.

Figure 5:
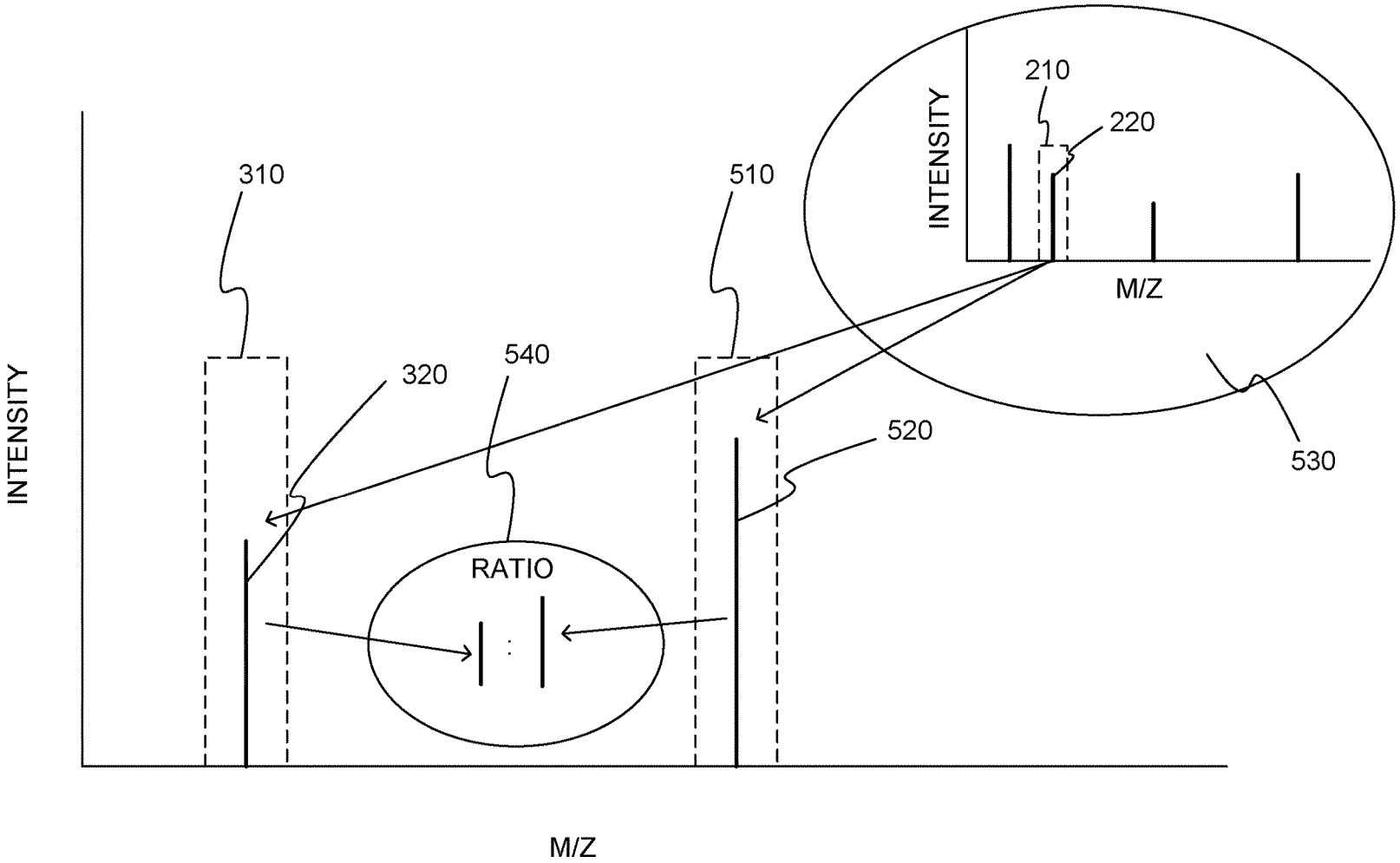
(PRIOR ART) FIG. 5
FIG. 5 is an exemplary plot of intensity versus m/z showing the mass windows for two different product ions of the same selected precursor ion and the two MRM product ion intensities measured for the two separate MRMs.

FIG. 5 is an exemplary plot 500 of intensity versus m/z showing the mass windows for two different product ions of the same selected precursor ion and the two MRM product ion intensities measured for the two separate MRMs. In FIG. 5, mass window 310 is used to monitor the intensity of product ion 320 of a first MRM, and mass window 510 is used to monitor the intensity of product ion 520 of a second MRM. Inset 530 shows that both the first MRM transition and the second MRM transition include the precursor ion 220.

In order to determine if the first MRM includes an interference, the ratio of the intensity of product ion 320 to the intensity of product ion 520 is compared to a standard ratio obtained from a library of measurements made by the same mass spectrometry system from standard samples of the compound of interest. Inset 540 shows the ratio of the intensities of product ions 320 and 520. If the difference between the ratio and the standard ratio is less than a threshold value, it is determined that the first MRM measurement does not include an interference. Similarly, if the difference is greater than or equal to the threshold value, it is determined that the first MRM measurement does include an interference.

One drawback of this method is that it also requires the library of measurements made from standard samples for a particular mass spectrometer. As a result, there is a need for systems and methods for determining interferences in MRM measurements that are not dependent on comparisons with libraries built from standard samples.

In various embodiments, instead of relying on multiple different product ions to determine interferences, different isotopic precursor ions are used. This is made possible by using a higher resolution precursor ion mass selection window (quadrupole 1 (Q1) isolation at less than <0.2 m/z). Two or more MRM transitions can be used. In each MRM the same product ion is monitored using a resolution window of about 3 m/z. By comparing the ratio of at least two MRM measurements acquired in this fashion, the ratio is expected to match the theoretical isotope ratio of the precursor ion, thus eliminating the need to acquire a library of MRM ratios or standards. Any deviation from the theoretical ratio indicates contamination or uncertainty associated with the MRM signal.

This method can be applied to any type of compound. However, the product ions of peptides, in particular, are typically free of any interference due to fragmentation rearrangements. For peptides, selection of a product ion that is "free of rearrangements" is simplified by relying on a product ion that is typically above the precursor ion m/z, simplifying the processing and setup of experiments.

Figure 6:
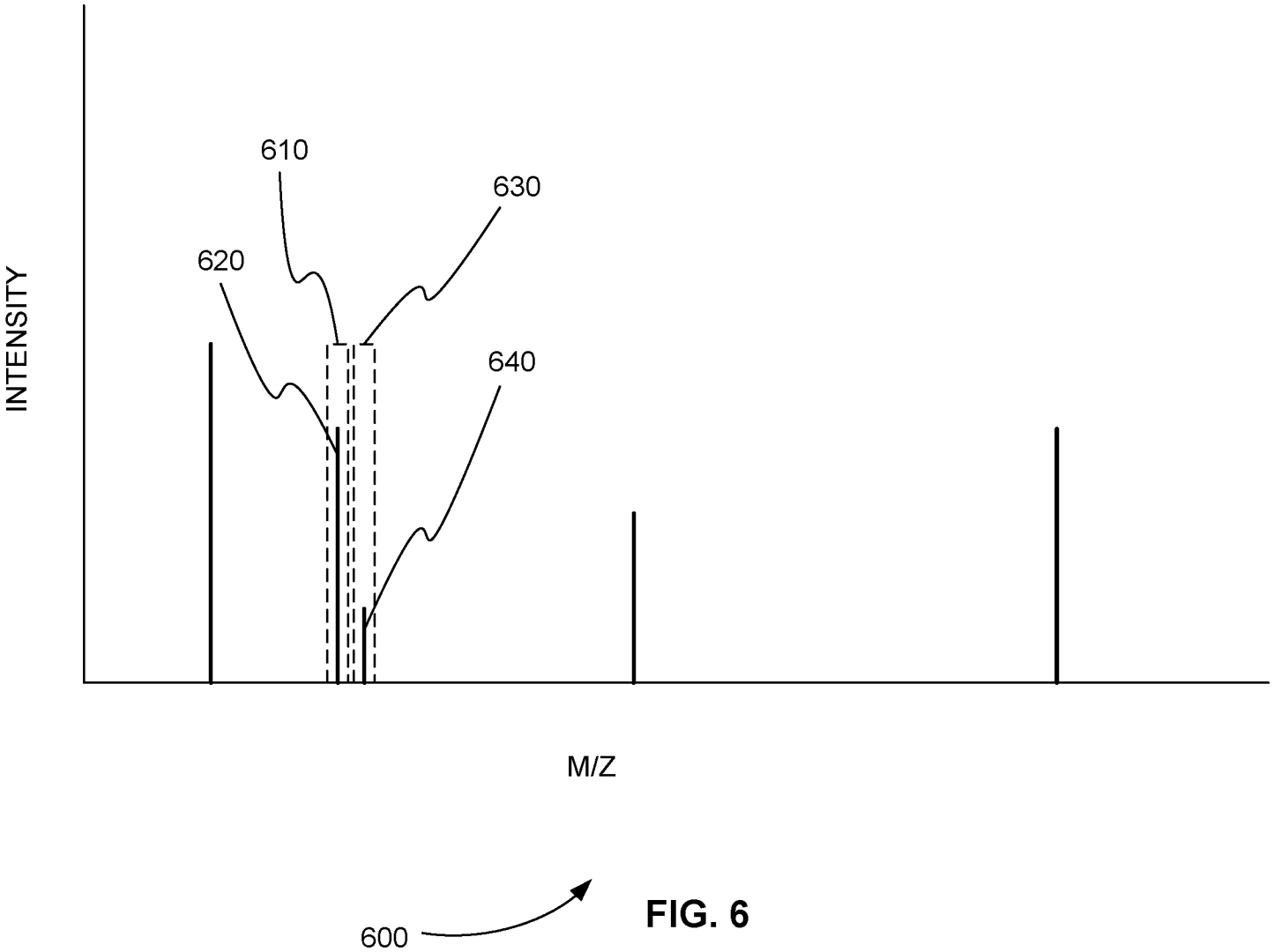
FIG. 6 is an exemplary plot of intensity versus m/z showing two mass selection windows used to select isotopic precursor ions used in two different MRM transitions, in accordance with various embodiments.

FIG. 6 is an exemplary plot 600 of intensity versus m/z showing two mass selection windows used to select isotopic precursor ions used in two different MRM transitions, in accordance with various embodiments. In FIG. 6, for a first MRM transition, mass selection window 610 is used to select first precursor ion 620. For a second MRM transition, mass selection window 630 is used to select second precursor ion 640 that is an isotope of precursor ion 620. Mass selection windows 610 and 630 are much narrower or have a higher resolution than windows used in conventional MRM in order to distinguish isotopic precursor ions. Each of mass selection windows 610 and 630 has a width of less than 0.2 m/z, for example.

Mass selection window 610 is use to select precursor ion 620 as part of a first MRM. Precursor ion 620 is then fragmented and the intensity of a product ion is measured for the first MRM. Similarly, mass selection window 630 is used to select precursor ion 640 as part of a second MRM. Precursor ion 640 is then fragmented and the intensity of the same product ion that was used in the first MRM transition is measured for the second MRM.

Figure 7:
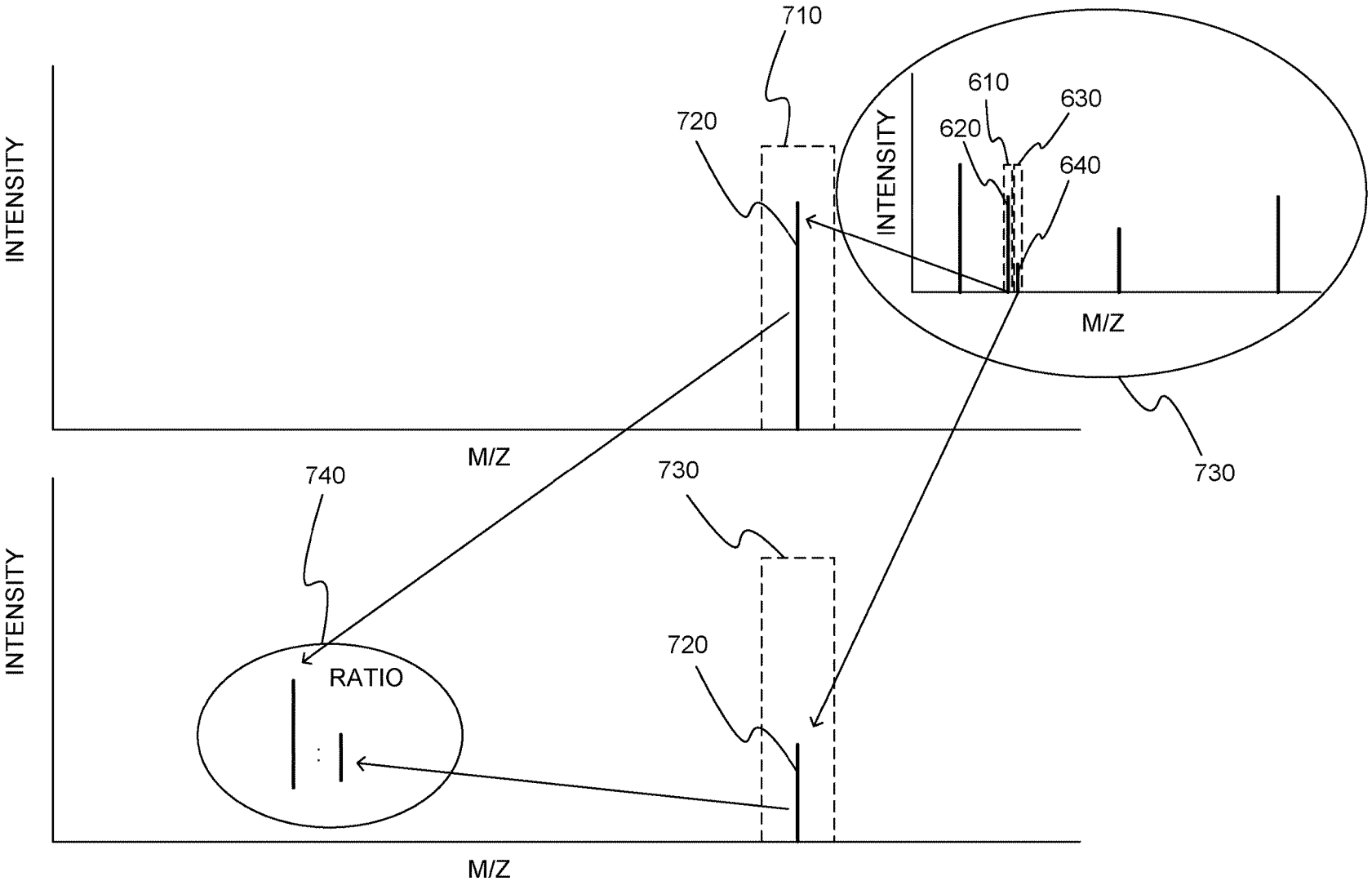
FIG. 7 is a view of two aligned plots of intensity versus m/z showing the mass windows for measuring the same product ion fragmented from two different isotopic precursor ions selected in two separate MRMs, in accordance with various embodiments.

FIG. 7 is a view 700 of two aligned plots of intensity versus m/z showing the mass windows for measuring the same product ion fragmented from two different isotopic precursor ions selected in two separate MRMs, in accordance with various embodiments. In FIG. 7, mass window 710 is used to monitor a first intensity of product ion 720 of a first MRM, and mass window 730 is used to monitor a second intensity of the same product ion 720 of a second MRM. Inset 730 shows that the first MRM transition includes precursor ion 620 and the second MRM transition includes precursor ion 640, which is an isotopic precursor ion of precursor ion 620.

In order to determine if the first MRM includes an interference, the ratio of the first intensity of product ion 720 to the second intensity of product ion 720 is compared to a theoretical ratio of the quantities of precursor ions 620 and 640. Inset 740 shows the ratio of the first intensity of product ion 720 to the second intensity. If the difference between the ratio and the theoretical ratio is less than a threshold value, it is determined that the first MRM measurement does not include an interference. Similarly, if the difference is greater than or equal to the threshold value, it is determined that the first MRM measurement does include an interference.

Comparison of FIGS. 5 and 7 shows the difference between the conventional method of using MRM transitions with different product ions and the method that employs MRM transitions with different isotopic precursor ions. In the conventional method of using MRM transitions with different product ions, each transition uses the same precursor ion and a different product ion. In the method that employs MRM transitions with different isotopic precursor ions, each transition uses a different isotopic precursor but the same product ion.

In addition, in the conventional method, the ratio of the intensities of the two different product ions is compared to a ratio found from a standard library. In contrast, in the isotopic MRM transition method, the ratio of the intensities of the same product ion from the two different transitions is compared to a theoretical ratio of the quantities of the isotopic precursor ions.

System for Determining an MRM Interference

Figure 8:
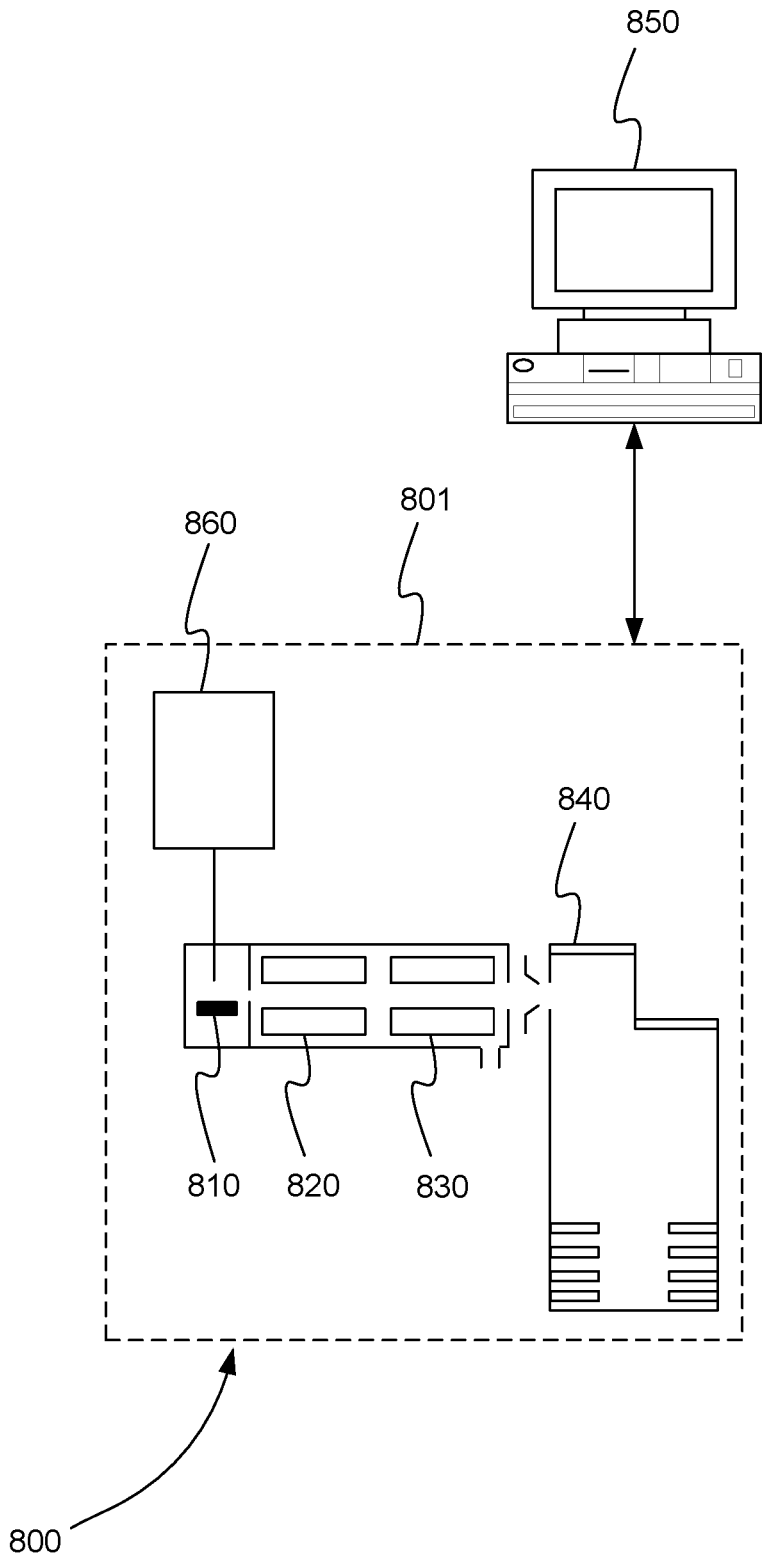
FIG. 8 is a schematic diagram of a system for determining if an MRM transition measurement for a compound of interest includes an interference, in accordance with various embodiments.

FIG. 8 is a schematic diagram of system 800 for determining if an MRM transition measurement for a compound of interest includes an interference, in accordance with various embodiments. System 800 includes tandem mass spectrometer 801 and processor 850. Tandem mass spectrometer 801 includes ion source device 810, mass filter 820, fragmentation device 830, and mass analyzer 840.

In various embodiments, tandem mass spectrometer 801 can further include sample introduction device 860. Sample introduction device 860 introduces one or more compounds of interest from a sample to ion source device 810 over time, for example. Sample introduction device 860 can perform techniques that include, but are not limited to, injection, liquid chromatography, gas chromatography, capillary electrophoresis, or ion mobility.

In system 800, mass filter 820, fragmentation device 830, and mass analyzer are shown as separate stages. In various embodiments, any or all of these stages can be combined into one or two stages.

Ion source device 810 transforms or ionizes a compound of interest producing an ion beam of one or more precursor ions. Ion source device 810 can perform ionization techniques that include, but are not limited to, matrix assisted laser desorption/ionization (MALDI) or electrospray ionization (ESI).

Tandem mass spectrometer 801 receives the ion beam from the ion source device. Mass filter 820 of tandem mass spectrometer 801 is adapted to produce a mass selection window capable of resolving isotopes of precursor ions from the ion beam. In various embodiments, mass filter 820 is adapted to produce a mass selection window a width of less than 0.2 m/z or even less than 0.15 m/z. In various embodiments mass filter 820 can include, but is not limited to, a quadrupole, an ion trap, a notch filter, or a hyperbolic set of rods.

Tandem mass spectrometer 801 is adapted to measure an intensity of an MRM transition by selecting a precursor ion of the MRM transition using mass filter 820, fragmenting the precursor ion using fragmentation device 830, and measuring an intensity of a product ion of the MRM transition using mass analyzer 840. In FIG. 8, fragmentation device 830 is shown as a quadrupole and mass analyzer 840 is shown as a time-of-flight (TOF) device. One of ordinary skill in the art can appreciate that any of these stages can include other types of mass spectrometry devices including, but not limited to, quadrupoles, ion traps, orbitraps, or Fourier transform ion cyclotron resonance (FT-ICR) devices.

Processor 850 can be, but is not limited to, a computer, a microprocessor, the computer system of FIG. 1, or any device capable of sending and receiving control signals and data from a tandem mass spectrometer and processing data. Processor 850 is in communication with tandem mass spectrometer 801.

Processor 850 instructs tandem mass spectrometer 801 to measure a first intensity of a first MRM transition that includes a first precursor ion and a first product ion. It instructs tandem mass spectrometer 801 to measure a second intensity of a second MRM transition that includes a second precursor ion and the same first product ion as the first MRM transition. The second precursor ion is an isotope of the first precursor ion.

Processor 850 then performs a number of calculations. It calculates a ratio of the first intensity to the second intensity. It calculates a theoretical ratio of the quantity of first precursor ion to the second precursor ion according to their isotopic relationship. It calculates a difference between the ratio and the theoretical ratio. Finally, it compares the difference to a threshold value. If the difference is less than the threshold value, it identifies the first intensity of the first MRM transition as including an interference for the compound of interest.

In various embodiments, the difference can be used as a quality metric. This quality metric can then be used, for example, to score intensity values.

Method for Determining an MRM Interference

Figure 9:
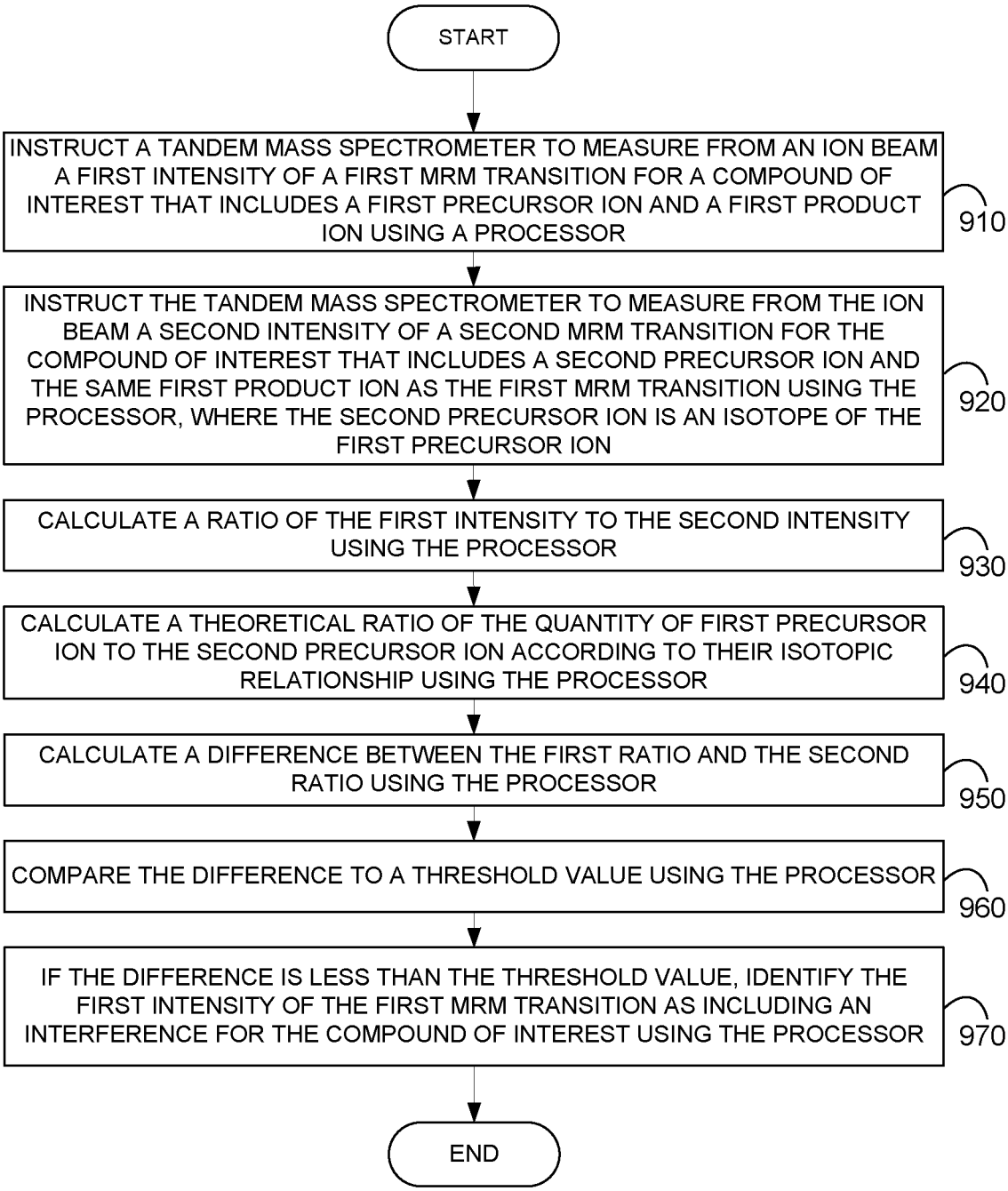
FIG. 9 is a flowchart showing a method for determining if an MRM transition measurement for a compound of interest includes an interference, in accordance with various embodiments.

FIG. 9 is a flowchart showing a method 900 for determining if an MRM transition measurement for a compound of interest includes an interference, in accordance with various embodiments.

In step 910 of method 900, a tandem mass spectrometer is instructed to measure from an ion beam a first intensity of a first MRM transition for a compound of interest that includes a first precursor ion and a first product ion using a processor. The tandem mass spectrometer includes a mass filter, a fragmentation device, and a mass analyzer. The tandem mass spectrometer receives the ion beam from an ion source device. The mass filter is adapted to produce a mass selection window capable of resolving isotopes of precursor ions from the ion beam. The tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer. The ion beam is produced by an ion source device that ionizes the compound of interest.

In step 920, the tandem mass spectrometer is instructed to measure from the ion beam a second intensity of a second MRM transition for the compound of interest that includes a second precursor ion and the same first product ion as the first MRM transition using the processor. The second precursor ion is an isotope of the first precursor ion.

In step 930, a ratio of the first intensity to the second intensity is calculated using the processor.

In step 940, a theoretical ratio of the quantity of first precursor ion to the second precursor ion is calculated according to their isotopic relationship using the processor.

In step 950, a difference between the ratio and the theoretical ratio is calculated using the processor.

In step 960, the difference is compared to a threshold value using the processor.

In step 970, if the difference is less than the threshold value, the first intensity of the first MRM transition is identified as including an interference for the compound of interest using the processor.

Computer Program Product for Determining an MRM Interference

In various embodiments, computer program products include a tangible computer-readable storage medium whose contents include a program with instructions being executed on a processor so as to perform a method for determining if an MRM transition measurement for a compound of interest includes an interference. This method is performed by a system that includes one or more distinct software modules.

Figure 10:
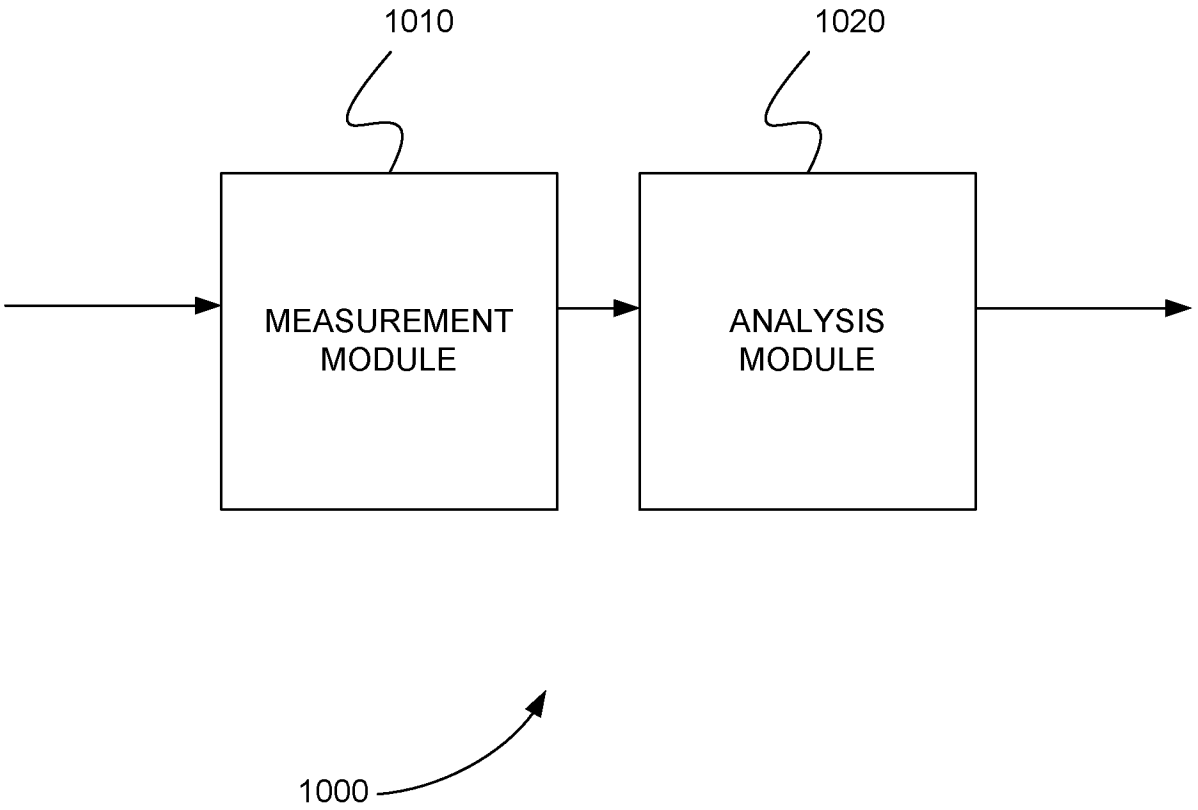
FIG. 10 is a schematic diagram of a system that includes one or more distinct software modules that performs a method for determining if an MRM transition measurement for a compound of interest includes an interference, in accordance with various embodiments.

FIG. 10 is a schematic diagram of a system 1000 that includes one or more distinct software modules that performs a method for determining if an MRM transition measurement for a compound of interest includes an interference, in accordance with various embodiments. System 1000 includes measurement module 1010 and analysis module 1020.

Measurement module 1010 instructs a tandem mass spectrometer to measure from an ion beam a first intensity of a first MRM transition for a compound of interest that includes a first precursor ion and a first product ion. The tandem mass spectrometer includes a mass filter, a fragmentation device, and a mass analyzer. The tandem mass spectrometer receives the ion beam from an ion source device. The mass filter is adapted to produce a mass selection window capable of resolving isotopes of precursor ions from the ion beam. The tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer. The ion beam is produced by an ion source device that ionizes the compound of interest.

Measurement module 1010 also instructs the tandem mass spectrometer to measure from the ion beam a second intensity of a second MRM transition for the compound of interest that includes a second precursor ion and the same first product ion as the first MRM transition. The second precursor ion is an isotope of the first precursor ion.

Analysis module 1020 performs a number of calculations. It calculates a ratio of the first intensity to the second intensity. It calculates a theoretical ratio of the quantity of first precursor ion to the second precursor ion according to their isotopic relationship. It calculates a difference between the ratio and the theoretical ratio. It compares the difference to a threshold value. Finally, if the difference is less than the threshold value, it identifies the first intensity of the first MRM transition as including an interference for the compound of interest.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for determining if a multiple reaction monitoring (MRM) transition measurement for a compound of interest includes an interference, comprising:

an ion source device that ionizes a compound of interest producing an ion beam of one or more precursor ions;

a tandem mass spectrometer that includes a mass filter, a fragmentation device and a mass analyzer and receives the ion beam from the ion source device, wherein the mass filter is adapted to produce a mass selection window capable of resolving isotopes of precursor ions from the ion beam and wherein the tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer; and a processor in communication with the tandem mass spectrometer that instructs the tandem mass spectrometer to measure a first intensity of a first MRM transition that includes a first precursor ion and a first product ion, instructs the tandem mass spectrometer to measure a second intensity of a second MRM transition that includes a second precursor ion and the same first product ion as the first MRM transition, wherein the second precursor ion is an isotope of the first precursor ion, calculates a ratio of the first intensity to the second intensity, calculates a theoretical ratio of the quantity of first precursor ion to the second precursor ion according to their isotopic relationship, calculates a difference between the ratio and the theoretical ratio, compares the difference to a threshold value, and if the difference is less than the threshold value, identifies the first intensity of the first MRM transition as including an interference for the compound of interest.

2. The system of claim 1, wherein the mass filter is adapted to produce a mass selection window a width of less than 0.2 m/z.

3. The system of claim 1, wherein the mass filter is adapted to produce a mass selection window a width of less than 0.15 m/z.

4. The system of claim 1, wherein the mass filter comprises a quadrupole.

5. The system of claim 1, wherein the mass filter comprises an ion trap.

6. The system of claim 1, wherein the mass filter comprises a notch filter.

7. The system of claim 1, wherein the mass filter comprises a hyperbolic set of rods.

8. The method of claim 1, wherein the mass filter comprises a quadrupole.

9. The method of claim 1, wherein the mass filter comprises an ion trap.

10. The method of claim 1, wherein the mass filter comprises a notch filter.

11. The method of claim 1, wherein the mass filter comprises a hyperbolic set of rods.

12. A method for determining if a multiple reaction monitoring (MRM) transition measurement for a compound of interest includes an interference, comprising:

instructing a tandem mass spectrometer to measure from an ion beam a first intensity of a first MRM transition for a compound of interest that includes a first precursor ion and a first product ion using a processor, wherein the tandem mass spectrometer includes a mass filter, a fragmentation device and a mass analyzer and receives the ion beam from an ion source device, wherein the mass filter is adapted to produce a mass selection window capable of resolving isotopes of precursor ions from the ion beam, wherein the tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer, and wherein the ion beam is produced by an ion source device that ionizes the compound of interest;

instructing the tandem mass spectrometer to measure from the ion beam a second intensity of a second MRM transition for the compound of interest that includes a second precursor ion and the same first product ion as the first MRM transition using the processor, wherein the second precursor ion is an isotope of the first precursor ion;

calculating a ratio of the first intensity to the second intensity using the processor;

calculating a theoretical ratio of the quantity of first precursor ion to the second precursor ion according to their isotopic relationship using the processor;

calculating a difference between the ratio and the theoretical ratio using the processor;

comparing the difference to a threshold value using the processor; and if the difference is less than the threshold value, identifying the first intensity of the first MRM transition as including an interference for the compound of interest using the processor.

13. The method of claim 12, wherein the mass filter is adapted to produce a mass selection window a width of less than 0.2 m/z.

14. The method of claim 12, wherein the mass filter is adapted to produce a mass selection window a width of less than 0.15 m/z.

15. A computer program product, comprising a non-transitory and tangible computer-readable storage medium whose contents include a program with instructions being executed on a processor so as to perform a method for determining if a multiple reaction monitoring (MRM) transition measurement for a compound of interest includes an interference, comprising:

providing a system, wherein the system comprises one or more distinct software modules, and wherein the distinct software modules comprise a measurement module and an analysis module;

instructing a tandem mass spectrometer to measure from an ion beam a first intensity of a first MRM transition for a compound of interest that includes a first precursor ion and a first product ion using the measurement module, wherein the tandem mass spectrometer includes a mass filter, a fragmentation device and a mass analyzer and receives the ion beam from an ion source device, wherein the mass filter is adapted to produce a mass selection window capable of resolving isotopes of precursor ions from the ion beam, wherein the tandem mass spectrometer is adapted to measure an intensity of an MRM transition by selecting a precursor ion of the MRM transition using the mass filter, fragmenting the precursor ion using the fragmentation device, and measuring an intensity of a product ion of the MRM transition using the mass analyzer, and wherein the ion beam is produced by an ion source device that ionizes the compound of interest;

instructing the tandem mass spectrometer to measure from the ion beam a second intensity of a second MRM transition for the compound of interest that includes a second precursor ion and the same first product ion as the first MRM transition using the measurement module, wherein the second precursor ion is an isotope of the first precursor ion;

calculating a ratio of the first intensity to the second intensity using the analysis module;

calculating a theoretical ratio of the quantity of first precursor ion to the second precursor ion according to their isotopic relationship using the analysis module;

calculating a difference between the ratio and the theoretical ratio using the analysis module;

comparing the difference to a threshold value using the analysis module; and if the difference is less than the threshold value, identifying the first intensity of the first MRM transition as including an interference for the compound of interest using the analysis module.

* * * * *